US005402551A

United States Patent [19]

Workhoven et al.

[11] Patent Number: 5,402,551

[45] Date of Patent: Apr. 4, 1995

[54] VACUUM HOSE STORAGE AND ACCESS APPARATUS FOR A CENTRAL VACUUM CLEANING SYSTEM

[76] Inventors: Garry Workhoven, 51212 Range Road 232, Sherwood Park, Alberta, Canada, T8B 1K8; Thel Dvernichuk, 4407-54 Avenue, Beaumont, Alberta, Canada, T4X 1J6

[21] Appl. No.: 198,259

[22] Filed: Feb. 18, 1994

[30] Foreign Application Priority Data

Apr. 8, 1993 [CA] Canada ..... 2093715

[51] Int. Cl.[6] ..... A47L 9/24

[52] U.S. Cl. ..... 15/315; 137/355.26; 242/390.8

[58] Field of Search ..... 15/315; 242/390.8, 390.9, 242/394; 137/355.26

[56] References Cited

U.S. PATENT DOCUMENTS

| | | | |
|---|---|---|---|
| 2,599,423 | 6/1962 | Ziegler | 242/390.8 |
| 2,641,790 | 6/1963 | Coult | 15/315 |
| 3,528,621 | 9/1970 | Lyle | 242/390.8 |
| 3,911,944 | 10/1975 | Hukuba et al. . | |
| 3,958,297 | 5/1975 | Hukuba et al. . | |
| 4,688,292 | 8/1987 | Schmiegel . | |
| 4,903,911 | 2/1990 | Sepke . | |
| 5,095,577 | 3/1992 | Jonas et al. | 15/315 |
| 5,119,843 | 6/1992 | Keenan | 137/355.26 X |

FOREIGN PATENT DOCUMENTS

| | | | |
|---|---|---|---|
| 1235380 | 5/1960 | France | 15/315 |

*Primary Examiner*—Christopher K. Moore
*Attorney, Agent, or Firm*—Anthony R. Lambert

[57] ABSTRACT

A vacuum hose storage and access apparatus for a central vacuum cleaning system is described, which includes a power unit. A 12 volt direct current retraction motor powered by the power unit is mounted on a base and has an output shaft. A gear reduction unit is provided having an input shaft and an output shaft. The input shaft is rotatably coupled to the output shaft of the motor. A clutch is disposed between the output shaft of the gear reduction unit and a vacuum hose reel. The clutch has an engaged position and a disengaged position. In the disengaged positioned the reel is freely rotatable thereby enabling vacuum hose to be freely pulled from the reel. In the engaged position the reel is indirectly coupled through the gear reduction unit to the output shaft of the motor such that upon rotation of the output shaft of the motor the output shaft of the gear reduction unit rotates the reel at a reduced rate of rotations per minute in a direction which retracts the vacuum hose back onto the reel.

8 Claims, 4 Drawing Sheets

VACUUM HOSE STORAGE AND ACCESS APPARATUS FOR A CENTRAL VACUUM CLEANING SYSTEM

The present invention relates to a vacuum hose storage and access apparatus for a central vacuum cleaning system.

BACKGROUND OF THE INVENTION

Central vacuum cleaning systems have a powerful vacuum cleaner permanently installed at a location within a building. The vacuum cleaner is connected by way of a network of tubing to outlets strategically positioned to service areas with the building. In order to use the central vacuum, a flexible hose is plugged into one of the outlets.

The advantage provided by a central vacuum system is that a person using the system need not manually manipulate the vacuum cleaner. This makes the task of vacuuming less physically demanding. It also enables a larger vacuum cleaner to be used which delivers more suction; as compared to manually manipulated vacuum cleaners in which there are unavoidable functional limits as size and weight.

In order to enable a person using the central vacuum system to vacuum a large area from one outlet, hoses approximately 25 to 40 feet long are used. Hoses of such length can be difficult to manipulate, which decreases the advantage of the central vacuum system. In order to address the problem of storing, carrying and handling such lengths of hose a number of vacuum hose storage and access apparatus have been developed. U.S. Pat. No. 4,903,911 granted to Sepke in 1990 discloses a reel which is manipulated by means of a crank. U.S. Pat. No. 5,119,843 granted to Keenan in 1992 discloses a reel which uses a retraction spring with a ratchet mechanism and a hose guide mechanism to ensure that upon retraction the hose is guided back onto the reel in tight rows.

There are number of disadvantages with use of a retraction spring with a ratchet mechanism. It is very difficult to maintain a consistent torque, as the greater the length of hose pulled from the reel the tighter the spring tends to become wound. With prolonged use the spring will become fatigued and the ratchet mechanism will wear.

These disadvantages may be overcome through the use of a motorized retraction mechanism. In the Keenan patent it was noted that the described hose guide mechanism could be used in combination with alternate sources of retraction torque, such as an electric motor. Electric motors have been used to wind and unwind conduit of various descriptions from reels in industrial applications. An example of this is U.S. Pat. No. 4,315,522 which issued to Brown in 1982. Motorized retraction mechanisms used in industrial applications are not, however, appropriate for central vacuum cleaning systems. Use with central vacuum cleaning systems brings into play functional limitations as to size and weight, as well as safety concerns.

SUMMARY OF THE INVENTION

What is required is a vacuum hose storage and access apparatus for a central vacuum cleaning system having a motorized retraction mechanism.

According to the present invention there is provided a vacuum hose storage and access apparatus for a central vacuum cleaning system. As with other similar devices the present invention has a base with a rotatably mounted reel and means for coupling a vacuum hose on the reel with a vacuum outlet of a building. The present invention includes a power unit. A 12 volt direct current retraction motor is mounted on the base and has an output shaft. The motor is powered by the power unit. A gear reduction unit is provided having an input shaft and an output shaft. The input shaft is rotatably coupled to the output shaft of the motor. Clutch means are disposed between the output shaft of the gear reduction unit and the reel. The clutch has an engaged position and a disengaged position. In the disengaged positioned the reel is freely rotatable thereby enabling vacuum hose to be freely pulled from the reel. In the engaged position the reel is indirectly coupled through the gear reduction unit to the output shaft of the motor such that upon rotation of the output shaft of the motor the output shaft of the gear reduction unit rotates the reel at a reduced rate of rotations per minute in a direction which retracts the vacuum hose back onto the reel.

It is preferred that the power unit include a transformer having an input terminal and an output terminal. Means for connecting the input terminal of the transformer to a power supply in a building such that the transformer reduces an input voltage for the power supply of the building to an output voltage at the output terminal of 16 volts alternating current. A rectifier connected to the output terminal of the transformer whereby the output current of the transformer is converted from alternating current to direct current. The apparatus, as described, is adapted for use in conjunction with a central vacuum system. The use of the transformer reduces the voltage which is used to levels which reduce the potential hazard to persons using the vacuum and their children. The use of a small 12 volt direct current motor reduces the size and weight of the apparatus. The use of a D.C. motor permits increased retraction torque as compared to an A.C. motor of comparable size and weight. The gear reduction unit slows down the rate of retraction to ensure that damage or injury does not result.

Although beneficial results may be obtained through the use of the apparatus as described, many consumers prefer to used electric powered "beater bars" and other such accessories to enhance the performance of their vacuums. Even more beneficial results may, therefore, be obtained by having means to deliver power to accessories; bearing in mind these accessories are generally positioned at an end of the vacuum hose remote from the base. In accordance with this aspect of the invention at least one pair of contacts is provided on the base immediately adjacent the reel. An power output line extends from the power unit to the primary contact. A contact plate is secured to a side of the reel adjacent to the primary contact. The contact plate is in physical communication with the primary contact, such that an electrical contact is constantly maintained between the contact and the contact plate as the reel rotates. Means is provided to connect a power cord to the contact plate.

The apparatus, as described, is capable of delivering an uninterrupted source of power to accessories. However, not all accessories have the same power requirements. Although beneficial results may be obtained through the use of the apparatus as described, even more beneficial results may be obtained by when the contact plate has a plurality of electrically isolated annular rings such that the contact plate communicates with a plurality of contacts to transmit power at differing voltages.

It is preferred that one accessory coupled to the contact plate be a line connected to a remote control switch positioned at a remote end of the vacuum hose whereby the retraction motor is remotely activated to retract the vacuum hose back onto the reel.

Although beneficial results may be obtained through the use of the vacuum hose storage and access apparatus, as described, problems can be encountered in connecting a rotating reel with a stationary vacuum hose connection. Even more beneficial results may, therefore, be obtained when the means of coupling a vacuum hose on the reel with a vacuum outlet of a building includes a passage on the rotational axis of the rotatably mounted reel and a stationary vacuum conduit receptacle having a male member extendable into passage.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
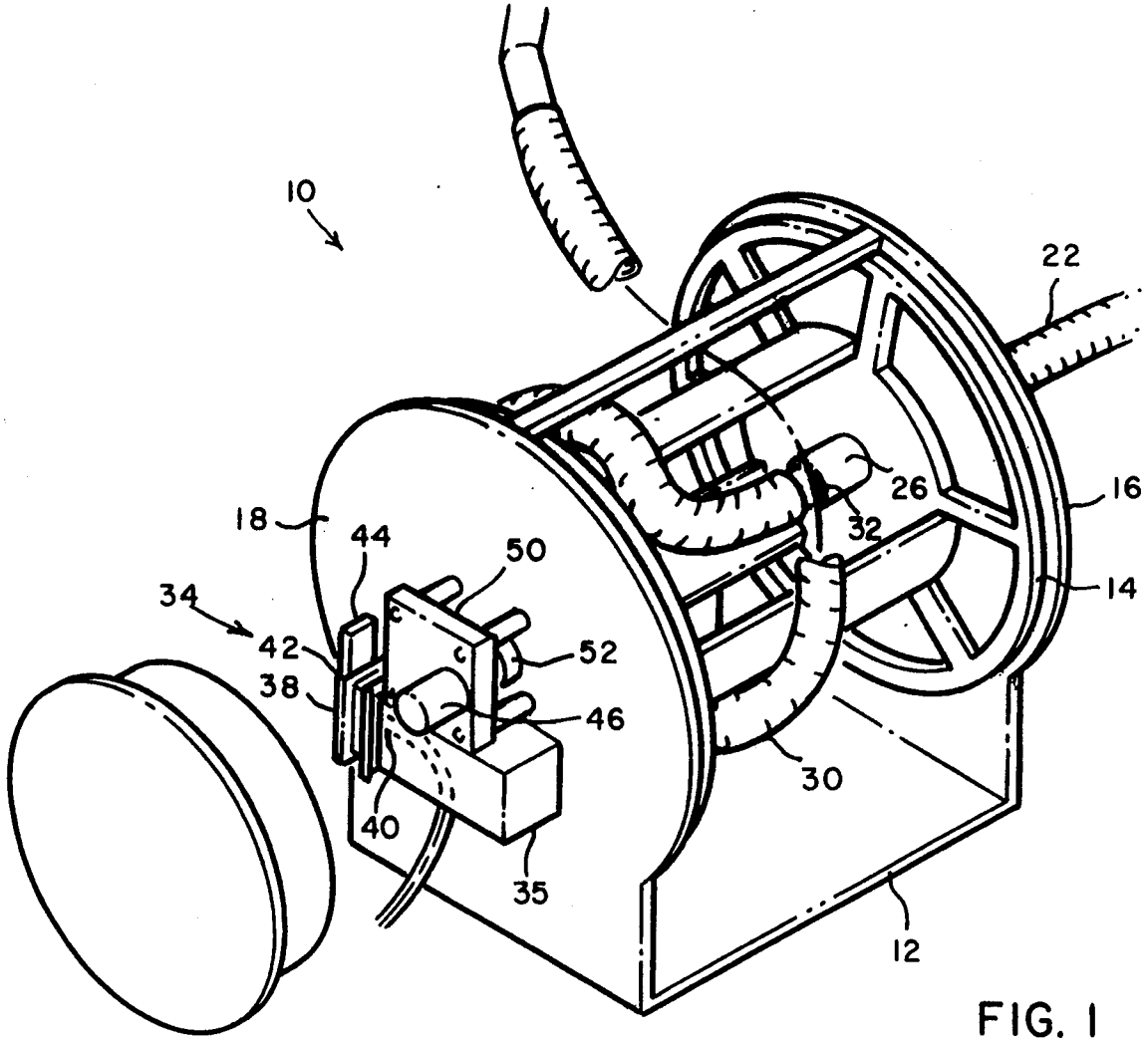
FIG. 1 is a perspective view of a vacuum hose storage and access apparatus constructed in accordance with the teachings of the present invention.

The preferred embodiment, a vacuum hose storage and access apparatus for a central vacuum system generally identified by reference numeral 10, will now be described with reference to FIGS. 1 through 4.

Figure 2:
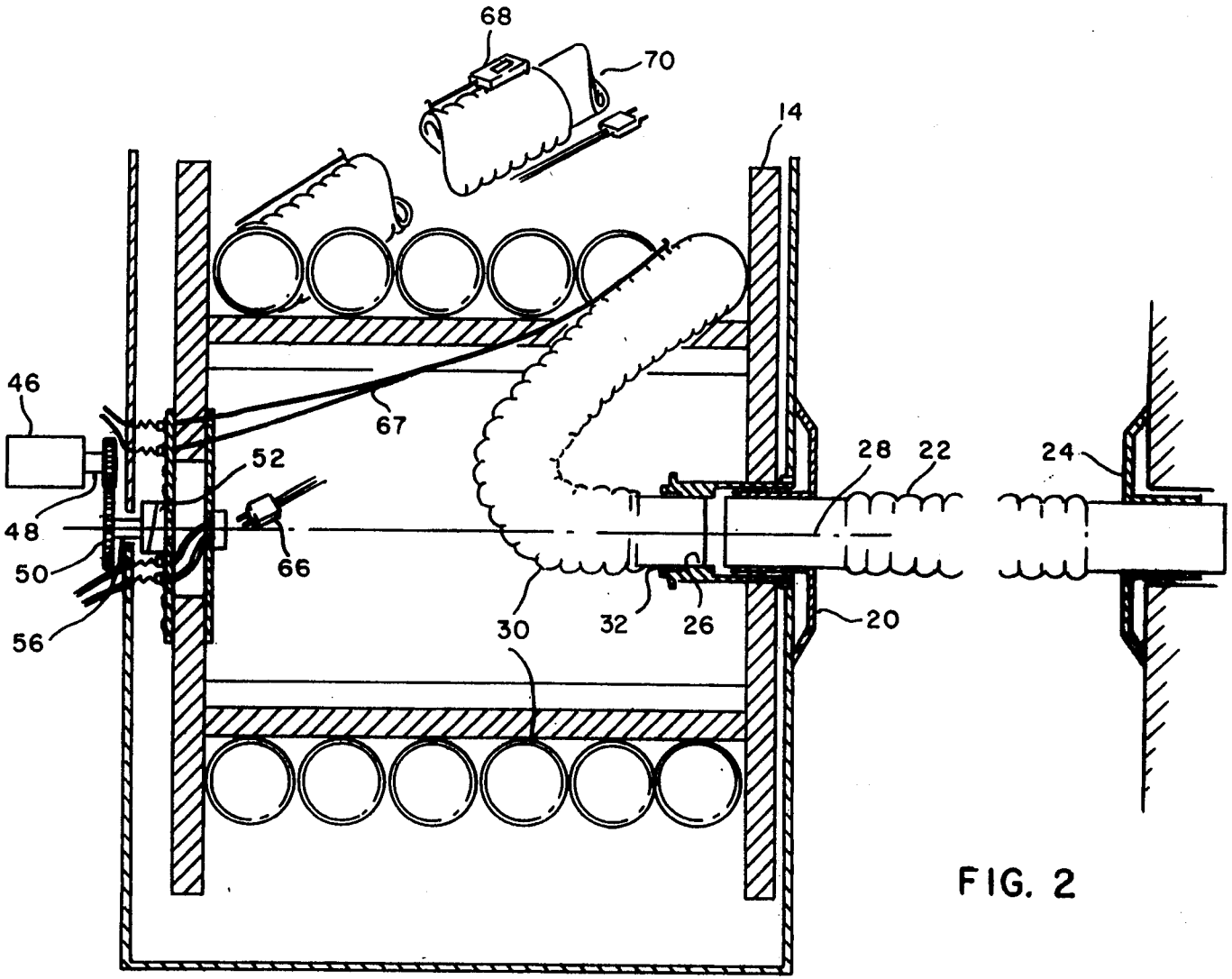
FIG. 2 is a side elevation view in longitudinal section of the vacuum hose storage and access apparatus illustrated in FIG. 1.
Figure 3:
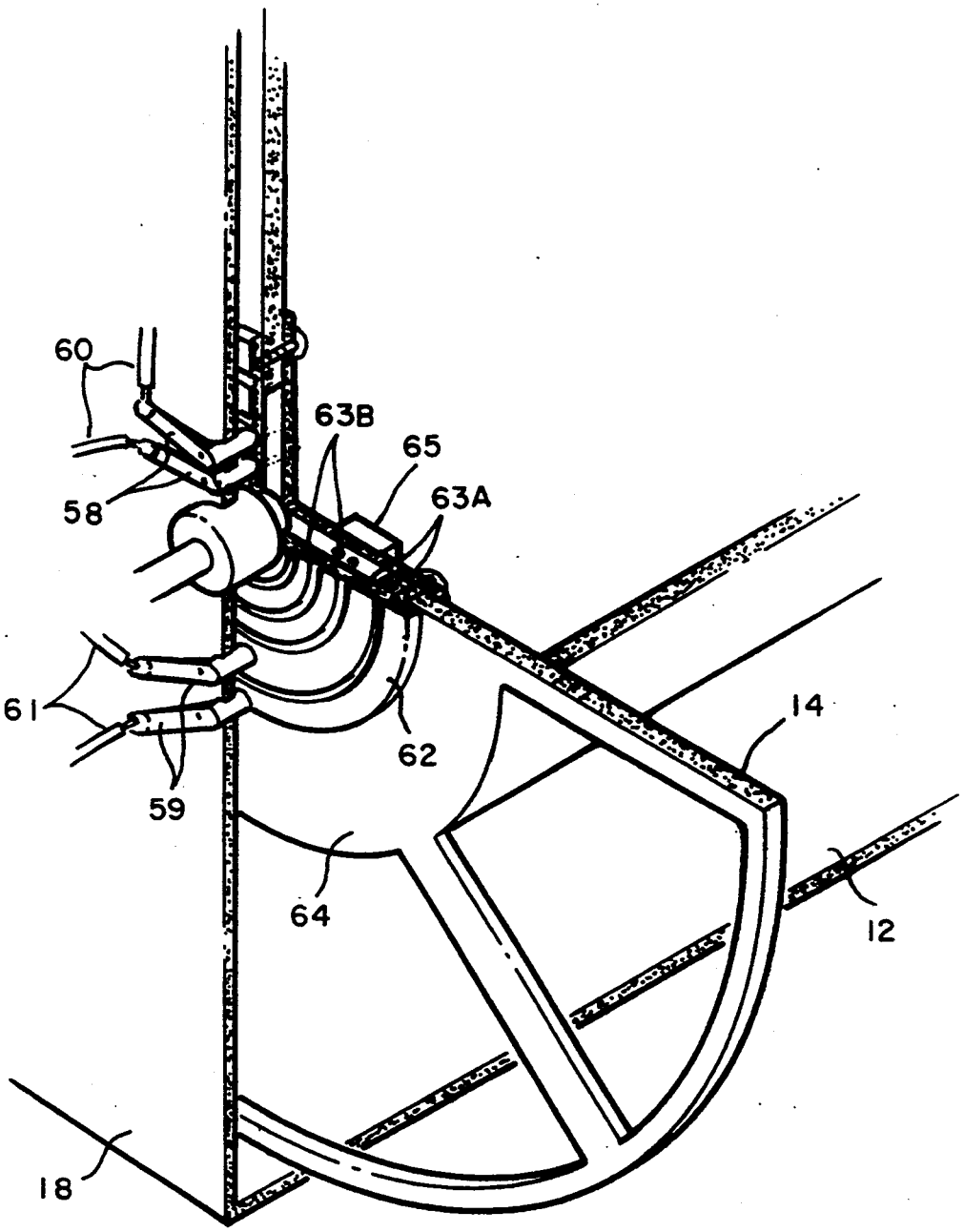
FIG. 3 is a partially cut away perspective view of the vacuum hose storage and access apparatus illustrated in FIG. 1.
Figure 4:
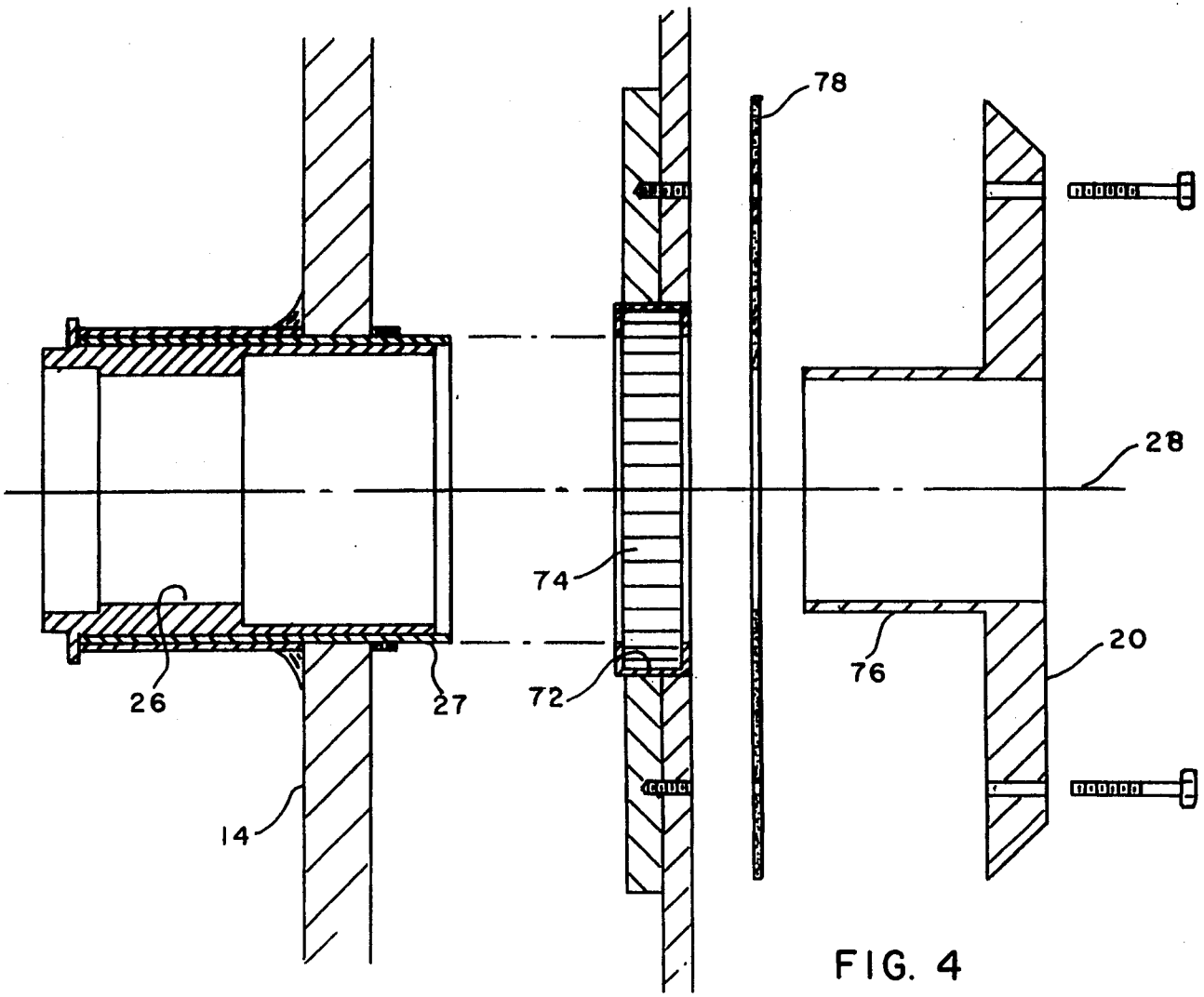
FIG. 4 is a detailed section view of a vacuum hose connection of the vacuum storage and access apparatus illustrated in FIG. 2.

Referring to FIGS. 1 and 2, vacuum hose storage and access apparatus 10 consists of a base 12 with a rotatably mounted reel 14. Base 12 has a first side 16 and a second side 18. First side 16 of base 12 has a vacuum conduit receptacle 20 adapted to receive a short length of vacuum conduit 22 which couples vacuum conduit receptacle 20 with a vacuum outlet 24 of a building. Vacuum conduit receptacle 20, in turn, communicates with connecting passage 26 on reel 14. Vacuum conduit receptacle 20 and connecting passage 26 are positioned on a rotational axis 28 for reel 14. A vacuum hose 30 is received in one end 32 of connecting passage 26 opposed to vacuum conduit receptacle 20. A power unit, generally indicated by reference numeral 34 is mounted to side 18 of base 12. Power unit 34 is connected through a junction box 35 with a power supply in a building. Power unit 34 includes a transformer 38 having an input terminal 40 and an output terminal 42. Transformer 38 reduces an input voltage received at input terminal 40 from the power supply of the building to an output voltage at output terminal 42 of 16 volts alternating current. A rectifier 44 is connected to output terminal 42 of transformer 38 whereby the output current of transformer 38 is converted from alternating current to direct current. A 12 volt direct current retraction motor 46 is mounted on base 12 and has an output shaft 48. A gear reduction unit 50 is provided having an output shaft 56. The gear reduction unit 50 is rotatably coupled to output shaft 48 of motor 46. A clutch 52 is disposed between output shaft 56 of gear reduction unit 50 and reel 14. Referring to FIG. 3, base 12 has a pair of primary contacts 58 and a pair of accessory contacts 59 immediately adjacent reel 14. A power line 60 with full 110 volt power extends from power unit 34 to primary contacts 58. An accessory power output line 61 with a reduced voltage of 16 volts extends from transformer 38 to the accessory contacts 59. An contact plate 62 is secured to a side 64 of reel 14. Contact plate 62 is in physical communication with primary contacts 58 and accessory contacts 59, such that an electrical contact is constantly maintained between contacts 58, 59 and contact plate 62 as reel 14 rotates. Contact plate 62 has a number of electrically isolated annular rings **63*a*, and 63*b* which permit power to be transmitted at differing voltages. Primary contacts 58 are in communication with rings 63*b*; accessory contacts 59 are in communication with rings 63*a*. Rings 63*b* communicate with a plug receptacle 65 mounted to reel 14. Plug receptacle 65 is adapted to receive a power cord 66 which supplies power to a power driven beater bar attachment (not shown). Rings 63*a* communicate with a line 67 attached to a remote control switch 68 positioned at a remote end 70 of vacuum hose 30. Referring to FIG. 4, a special connection is required between vacuum conduit receptacle 20 and connecting passage 26 on reel 14, due to the fact that vacuum conduit receptacle 20 is stationary, whereas connecting passage 26 must rotate with reel 14. Connecting passage 26 has a flange 27 which protrudes past reel 14. Flange 27 is received in a reel mounting aperture 72 in first side 16 of base 12 which is positioned along rotational axis 28. A bearing 74 is disposed between flange 27 and reel mounting aperture 72. Vacuum conduit receptacle 20 has a male member 76 that extends into connecting passage 26. Male member 76 of vacuum conduit receptacle 20 remains stationary while connecting passage 26 rotates. A gasket 78 positioned between vacuum conduit receptacle 20 and first side 16 of base 12** provides sufficient sealing to maintain vacuum pressure.

The use and operation of vacuum hose storage and access apparatus 10 will now be described with reference to FIGS. 1 through 4. Clutch 52 has an engaged position and a disengaged position. In the disengaged positioned reel 14 is freely rotatable thereby enabling vacuum hose 30 to be freely pulled from reel 14. In the engaged position, reel 14 is indirectly coupled through gear reduction unit 52 to output shaft 48 of motor 46 such that upon rotation of output shaft 48 of motor 46, output Shaft 56 of gear reduction unit 52 rotates reel 14 at a reduced rate of rotations per minute in a direction which retracts vacuum .hose 30 back onto reel 14. The provision of remote control switch 68 enables retraction motor 46 to be remotely activated to retract vacuum hose 30 back onto reel 14.

It will be apparent to one skilled in the art that modifications may be made to the illustrated embodiment without departing from the spirit and scope of the invention as defined by the claims.

The embodiments of the invention in which an exclusive property or privilege is claimed are defined as follows:

1. A vacuum hose storage and access apparatus for a central vacuum cleaning system having a base with a rotatably mounted reel and means for coupling a vacuum hose on the reel with a vacuum outlet of a building, characterized by a power unit comprised of:

a. a power unit;

b. a 12 volt direct current retraction motor mounted on the base and having an output shaft, the motor being supplied power by the power unit;

c. a gear reduction unit having an output shaft, the gear reduction unit being rotatably coupled to the output shaft of the motor; and d. clutch means disposed between the output shaft of the gear reduction unit and the reel, the clutch having an engaged position and a disengaged position such that in the disengaged positioned the reel is freely rotatable thereby enabling vacuum hose to be freely pulled from the reel and in the engaged position the reel is indirectly coupled through the gear reduction unit to the output shaft of the motor such that upon rotation of the output shaft of the motor the output shaft of the gear reduction unit rotates the reel at a reduced rate of rotations per minute in a direction which retracts the vacuum hose back onto the reel.

2. The vacuum hose storage and access apparatus for a central vacuum cleaning system as defined in claim 1, the power unit including:

a. a transformer mounted on the base having an input terminal and an output terminal;

b. means for connecting the input terminal of the transformer to a power supply in a building such that the transformer reduces an input voltage for the power supply of the building to an output voltage at the output terminal of 16 volts alternating current; and c. a rectifier connected to the output terminal of the transformer whereby the output current of the transformer is converted from alternating current to direct current.

3. The vacuum hose storage and access apparatus for a central vacuum cleaning system as defined in claim 1, having means to deliver power to accessories coupled to an end of the vacuum hose remote from the base, comprising:

a. at least one pair of contacts on the base immediately adjacent the reel connected to the power unit;

b. an contact plate secured to a side of the reel adjacent to the contact, the contact plate being in physical communication with the contact, such that an electrical contact is constantly maintained between the contacts and the contact plate as the reel rotates; and c. means to connect accessories requiring power to the contact plate.

4. The vacuum hose storage and access apparatus for a central vacuum cleaning system as defined in claim 3, the contact plate having a plurality of electrically isolated annular rings such that the contact plate communicates with a plurality of contacts to transmit power at differing voltages.

5. The vacuum hose storage and access apparatus for a central vacuum cleaning system as defined in claim 3, the accessory coupled to the contact plate being a line connected to a remote control switch positioned at a remote end of the vacuum hose whereby the retraction motor is remotely activated to retract the vacuum hose back onto the reel.

6. The vacuum hose storage and access apparatus for a central vacuum cleaning system as defined in claim 1, the means for coupling a vacuum hose on the reel with a vacuum outlet of a building including a passage on the rotational axis of the rotatably mounted reel and a stationary vacuum conduit receptacle having a male member extendable into passage.

7. A vacuum hose storage and access apparatus for a central vacuum cleaning system having a base with a rotatably mounted reel and means for coupling a vacuum hose on the reel with a vacuum outlet of a building, characterized by a power unit comprised of:

a. a power unit, including:

i. a transformer mounted on the base having an input terminal and an output terminal;

ii. means for connecting the input terminal of the transformer to a power supply in a building such that the transformer reduces an input voltage for the power supply of the building to an output voltage at the output terminal of 16 volts alternating current;

iii. a rectifier connected to the output terminal of the transformer whereby the output current of the transformer is converted from alternating current to direct current;

b. a 12 volt direct current retraction motor mounted on the base and having an output shaft, the motor receiving power from the power unit;

c. a gear reduction unit having an output shaft, the gear reduction unit being rotatably coupled to the output shaft of the motor;

d. clutch means disposed between the output shaft of the gear reduction unit and the reel, the clutch having an engaged position and a disengaged position such that in the disengaged positioned the reel is freely rotatable thereby enabling vacuum hose to be freely pulled from the reel and in the engaged position the reel is indirectly coupled through the gear reduction unit to the output shaft of the motor such that upon rotation of the output shaft of the motor the output shaft of the gear reduction unit rotates the reel at a reduced rate of rotations per minute in a direction which retracts the vacuum hose back onto the reel;

e. means to deliver power to accessories, including i. a plurality of pairs of contacts on the base immediately adjacent the reel connected to the power unit;

ii. a contact plate having a plurality of electrically isolated annular rings secured to a side of the reel adjacent to the contact, the contact plate being in physical communication with the contacts, such that an electrical contact is constantly maintained between the contact and the contact plate as the reel rotates, each contact communicating with a different one of the plurality of annular rings; and iii. means to connect accessories requiring power to the contact plate; and f. the means for coupling a vacuum hose on the reel with a vacuum outlet of a building including a passage on the rotational axis of the rotatably mounted reel and a stationary vacuum conduit receptacle having a male member extendable into passage.

8. The vacuum hose storage and access apparatus for a central vacuum cleaning system as defined in claim 1, the accessory coupled to the contact plate being a line connected to a remote control switch positioned at a remote end of the vacuum hose whereby the retraction motor is remotely activated to retract the vacuum hose back onto the reel.

* * * * *